US006179506B1

(12) United States Patent
Dewberry

(10) Patent No.: US 6,179,506 B1
(45) Date of Patent: Jan. 30, 2001

(54) CAULKING ACCESSORY

(75) Inventor: Andrew Terrance Kevin Dewberry, 2047 Parker Street, Vancouver, British Columbia (CA), V5L 2L4

(73) Assignee: Andrew Terrance Kevin Dewberry, Vancouver ( * ) Notice: Under 35 U.S.C. 154(b), the term of this patent shall be extended for 0 days.

(21) Appl. No.: 09/342,658

(22) Filed: Jun. 29, 1999

(51) Int. Cl.[7] ..... B05C 11/00

(52) U.S. Cl. ..... 401/266; 401/265; 222/567

(58) Field of Search ..... 401/266, 265, 401/261, 264, 10, 193; 222/566, 567, 569, 570, 573

(56) References Cited

U.S. PATENT DOCUMENTS

| | | | | |
|---|---|---|---|---|
| 28,694 | | 6/1860 | Smith . | |
| D. 277,827 | | 3/1985 | Olsson . | |
| D. 289,881 | | 5/1987 | Krumm . | |
| D. 333,955 | | 3/1993 | Hatgas et al. . | |
| D. 335,809 | | 5/1993 | Reifenberger . | |
| D. 352,003 | | 11/1994 | Groene et al. . | |
| D. 355,576 | | 2/1995 | Groene et al. . | |
| D. 360,580 | | 7/1995 | Bomareto . | |
| D. 377,031 | | 12/1996 | Didier . | |
| 490,956 | | 1/1893 | Franzen . | |
| 2,012,846 | | 8/1935 | Bentzen . | |
| 2,330,034 | | 9/1943 | Doodchenko . | |
| 2,815,895 | | 12/1957 | Reed . | |
| 2,883,854 | | 4/1959 | Marmon . | |
| 2,953,285 | | 9/1960 | McKelvey . | |
| 3,058,632 | | 10/1962 | Stremmel . | |
| 3,129,020 | * | 4/1964 | Bujnowski | 222/570 |
| 3,439,839 | * | 4/1969 | Schumann et al. | 222/570 |
| 3,448,896 | | 6/1969 | Kobayashi et al. . | |
| 3,498,101 | | 3/1970 | Daniell . | |
| 3,570,726 | | 3/1971 | Pomodoro . | |
| 3,761,992 | | 10/1973 | Schneller . | |
| 4,101,077 | | 7/1978 | Gibson . | |
| 4,258,884 | | 3/1981 | Rogers . | |
| 4,380,425 | | 4/1983 | Edelman . | |
| 4,382,530 | * | 5/1983 | Calisto | 222/567 |
| 4,430,841 | | 2/1984 | Yamaguchi et al. . | |
| 4,555,286 | | 11/1985 | Orikasa et al. . | |

(List continued on next page.)

FOREIGN PATENT DOCUMENTS

| | | |
|---|---|---|
| 0241557 A1 | 10/1987 | (EP) . |
| 0241557 B1 | 2/1992 | (EP) . |
| 385244 | 12/1932 | (GB) . |
| 844416 | 8/1960 | (GB) . |
| 2225771 | 9/1990 | (JP) . |
| 2240379 | 9/1990 | (JP) . |
| WO 94/27001 | 11/1994 | (WO) . |

* cited by examiner

*Primary Examiner*—David J. Walczak
(74) *Attorney, Agent, or Firm*—Fulwider Patton Lee & Utecht, LLP

(57) ABSTRACT

A caulking accessory is for use with a caulking cartridge and caulking gun, particularly for sealing cracks. The caulking accessory comprises a body, a blocking portion located adjacent a distal end portion of the body, and a connecting portion located adjacent a proximal end portion of the body. The body has a body opening extending between the end portions and is cooperable with a nozzle of a caulking cartridge. The blocking portion communicates with the body opening and has a blocking surface cooperable with a surface to be sealed. The connecting portion has a pair of moveable arms on opposite sides of the body opening which cooperate with the caulking gun and cartridge to be retained thereon. Preferably, the arms are hinged with respect to the body so that, in an operative position thereof, the arms enclose portions of the nozzle therebetween. Preferably, the body opening has an opening sidewall and an annular flange with a flexible flange lip, the flange extending inwardly from the opening sidewall to the tip which cooperates with the nozzle to form a seal therewith.

19 Claims, 6 Drawing Sheets

U.S. PATENT DOCUMENTS

| | | | |
|---|---|---|---|
| 4,555,295 | 11/1985 | Orikasa et al. . | |
| 4,586,890 | 5/1986 | Marchbanks . | |
| 4,622,085 | 11/1986 | Yamada et al. . | |
| 4,637,531 | 1/1987 | Olsson | 222/327 |
| 4,673,346 | 6/1987 | Anderson . | |
| 4,878,599 | 11/1989 | Greenway . | |
| 4,946,081 | 8/1990 | Jacobson . | |
| 4,957,225 | 9/1990 | Childers . | |
| 4,986,862 | 1/1991 | Matsufuru . | |
| 4,995,540 | 2/1991 | Colin et al. . | |
| 5,017,113 | 5/1991 | Heaton et al. . | |
| 5,018,956 | 5/1991 | Lemaster . | |
| 5,033,951 | 7/1991 | Cook . | |
| 5,058,275 | 10/1991 | Staubli . | |
| 5,075,916 | 12/1991 | Englehart . | |
| 5,104,013 | 4/1992 | Hawley | 222/566 |
| 5,186,949 | 2/1993 | Lai . | |
| 5,239,725 | 8/1993 | White . | |
| 5,248,071 | 9/1993 | Ray . | |
| 5,249,716 | 10/1993 | O'Sullivan . | |
| 5,249,876 | 10/1993 | Hattman . | |
| 5,263,607 | 11/1993 | Temesvary et al. . | |
| 5,301,835 | 4/1994 | Fulks et al. . | |
| 5,312,384 | 5/1994 | Temple . | |
| 5,346,380 | 9/1994 | Ables . | |
| 5,372,761 | 12/1994 | Anderson, Sr. . | |
| 5,407,338 | 4/1995 | Callahan et al. . | |
| 5,429,308 | 7/1995 | Brown . | |
| 5,431,553 | 7/1995 | Topf, Jr. . | |
| 5,440,776 | 8/1995 | Kartler . | |
| 5,462,317 | 10/1995 | Keller . | |
| 5,536,457 | 7/1996 | Topf, Jr. . | |
| 5,566,866 | 10/1996 | Jacobsen et al. | 222/495 |
| 5,573,281 | 11/1996 | Keller . | |
| 5,775,551 | 7/1998 | Tordsen | 222/567 |
| 5,833,099 | 11/1998 | Boaz et al. . | |
| 5,865,555 | 2/1999 | Dawson | 401/266 |
| 5,882,133 | 3/1999 | Chao | 401/266 |

CAULKING ACCESSORY

BACKGROUND OF THE INVENTION

The invention relates to a caulking accessory for use with a caulking cartridge and caulking gun, the accessory being particularly adapted for sealing cracks in concrete or other surfaces.

A caulking cartridge for use with a conventional caulking gun comprises a cylindrical tube containing a plastic sealant material, and a nozzle or spout extending axially from an end face of the tube. For normal use the caulking cartridge is inserted into the caulking gun, and the nozzle is cut obliquely at an appropriate location to provide an obliquely cut tip of a size sufficient to produce a sealant bead of a desired size for the crack or cavity to be filled. This simple approach has many limitations and there are many patents disclosing devices which cooperate with the conventional caulking cartridge nozzle to simplify application of the sealant, and/or to improve the resulting application of sealant.

U.S. Pat. No. 5,017,113 (Heaton et al.) discloses a filleting attachment for a conventional caulking gun for use in corners. The nozzle of the conventional cartridge is cut and then inserted in a complementary tapered nozzle of the attachment to discharge sealant into the attachment. The attachment has an integrally moulded triangular shaped plate as a distal end thereof which engages walls of a 90 degree corner so as to guide the nozzle and simultaneously to shape the bead of sealant discharged from the nozzle. The attachment has a simple annular end flange for fitting between a generally annular end flange of the conventional caulking gun and an end face of the caulking cartridge.

U.S. Pat. No. 4,946,081 (Jacobson) discloses an applicator for a sealant cartridge having a discharge nozzle with a semi-cylindrical tubular portion disposed perpendicularly to a distal end of the nozzle. The tubular portion has an open end to discharge excess sealant therethrough to provide a flow indicator ensuring adequate filling of the crack. The applicator is screw-threaded onto a sleeve extending from the outer face of the cartridge, and thus is specifically adapted for use with a cartridge having complementary threads or an interference fit, or other means of securing the applicator to the opening of the sealant cartridge.

The nozzles of common, conventional sealant cartridges are generally similar in size and taper, and thus many of the applicators or accessories designed to be used with such cartridges tend to rely on an interference fit between the applicator or accessory and the cartridge nozzle. It is often difficult to maintain an adequate seal using an interference fit, and thus inadvertent sealant leakage can occur between the nozzle and the applicator, especially if higher sealant pressure than normal is attained. Also, to attain adequate penetration of sealant into deep cracks, is advantageous to generate high sealing pressures, but these higher pressures cannot be attained if excessive leakage occurs between the nozzle and the applicator. Also, some prior art caulking accessories are attached to the caulking gun and cartridge in a relatively loose manner which can result in inadvertent displacement between the accessory and nozzle, further aggravating sealant loss. Also, sealant can inadvertently leak between a rough surface with the crack and the applicator Thus there is a need for a caulking applicator or accessory which can be used with conventional caulking guns and cartridges, and that provides an adequate seal with the cartridge nozzle to permit attainment of relatively high pressures for injecting sealant into relatively deep cracks.

In contrast with the two patents disclosed above which disclose devices for conventional, relatively small size caulking cartridges, U.S. Pat. No. 4,986,862 (Matsufuru) and U.S. Pat. No. 5,186,949 (Lai) both disclose sealant applicators for use with larger, industrial-sized sealant containers which commonly use an injector to discharge sealant under relatively high pressure into the applicator for subsequent injection into a crack. A distal portion of the application in both these devices has a flat flange adapted to contact the surface containing the crack, the flange enclosing the crack so as to limit discharge of sealant from the crack until the crack has been substantially filled. Both these devices are relatively complex and require specialized equipment and would not be appropriate for use with conventional caulking guns and cartridges.

SUMMARY OF THE INVENTION

The invention reduces the difficulties and disadvantages of the prior art by providing a simple, caulking device which can be manufactured using conventional plastic injection die technology for a relatively low cost and is easily adaptable to the conventional caulking gun and cartridge. The device provides a secure and simple means for attachment to the caulking gun and cartridge, thus reducing relative movement therebetween. In addition, the device has a novel seal which cooperates with the caulking cartridge nozzle in such a way that as sealant pressure increases, the seal engages the nozzle more tightly, thus enhancing sealing. The device cooperates with most commercially available caulking guns and cartridges and can generate relatively high pressures for injection into relatively large cracks, particularly those found in concrete, building surfaces, etc. The previously described inadvertent loss of sealant between the nozzle and many prior art devices is thus reduced considerably, or essentially eliminated, thus reducing waste and permitting improved penetration of the sealant into the crack in view of the relatively high delivery pressure. In addition, there are two embodiments of the device that are for use on flat surfaces, or surfaces which intersect at a corner. The present device can also accommodate relatively rough surfaces so that the prior art inadvertent leakage of sealant between the device and the rough surface is also reduced.

A caulking device according to the invention is for use with a caulking gun and comprises a body, a blocking portion and a connecting portion. In a first embodiment of the device, the body has distal and proximal end portions, and a body opening extending between the end portions, the body opening being cooperable with a nozzle of a caulking cartridge. The blocking portion is located adjacent the distal end portion of the body, communicates with the body opening, and has a blocking surface cooperable with the surface to be sealed. The connecting portion is located adjacent the proximal end portion of the body and has a pair of moveable arms. The arms are located on opposite sides of the body opening and are cooperable with the caulking gun and caulking cartridge so as to be retained on the gun.

Preferably, the body opening has an opening axis, an opening sidewall and an annular flange with a flexible flange lip, the annular flange extending inwardly from the opening sidewall to the lip. The lip has a size and flexibility sufficient to cooperate with the nozzle of the caulking cartridge to form a seal therewith. Preferably, the arms of the connecting portion are hinged to the body to permit movement relative thereto between operable and inoperable positions. The arms are hinged with respect to the body about respective hinges which are disposed parallel to each other, the hinges having respective hinge axes which are parallel to each other and disposed generally perpendicularly to the opening axis.

Preferably, each arm has a distal arm portion, a proximal arm portion and an intermediate arm portion. The distal arm portion cooperates with a caulking cartridge and the caulking gun and the proximal arm portion cooperates with the hinge. The intermediate arm portion interconnects the distal and proximal arm portions and is shaped to engage a portion of the nozzle when the arm is in the operative position thereof. The distal arm portion is disposed generally perpendicularly to the intermediate arm portion and the intermediate arm portion has a concave inner face which is disposed generally concentrically of the body opening when the arm is in the operative position thereof.

An alternative caulking device for use as a caulking gun also comprises a body, a blocking portion and a connecting portion. The body has distal and proximal end portions, and a body opening extending between the end portions, the body opening being cooperable with the nozzle of a caulking cartridge. The body opening has an opening axis, an opening sidewall and an annular flange with a flexible flange lip, the annular flange extending inwardly from the opening sidewall to the lip. The lip has a size and a flexibility sufficient to cooperate with the nozzle of the caulking cartridge to form a seal therewith. The blocking portion is located adjacent the distal end portion of the body, and communicates with the body opening and has a blocking surface cooperable with a surface to be sealed. The connecting portion is located adjacent the proximal end portion of the body and is cooperable with the caulking gun and the caulking cartridge so as to be retained on the gun. Preferably, the lip of the annular flange is inclined towards the distal end portion of the body so as to be forced inwardly towards the opening axis when subjected to sealant pressure.

A detailed disclosure following, related to drawings, describes preferred embodiments of the invention which is capable of expression in structure other than that particularly described and illustrated.

DETAILED DESCRIPTION

Figure 1:
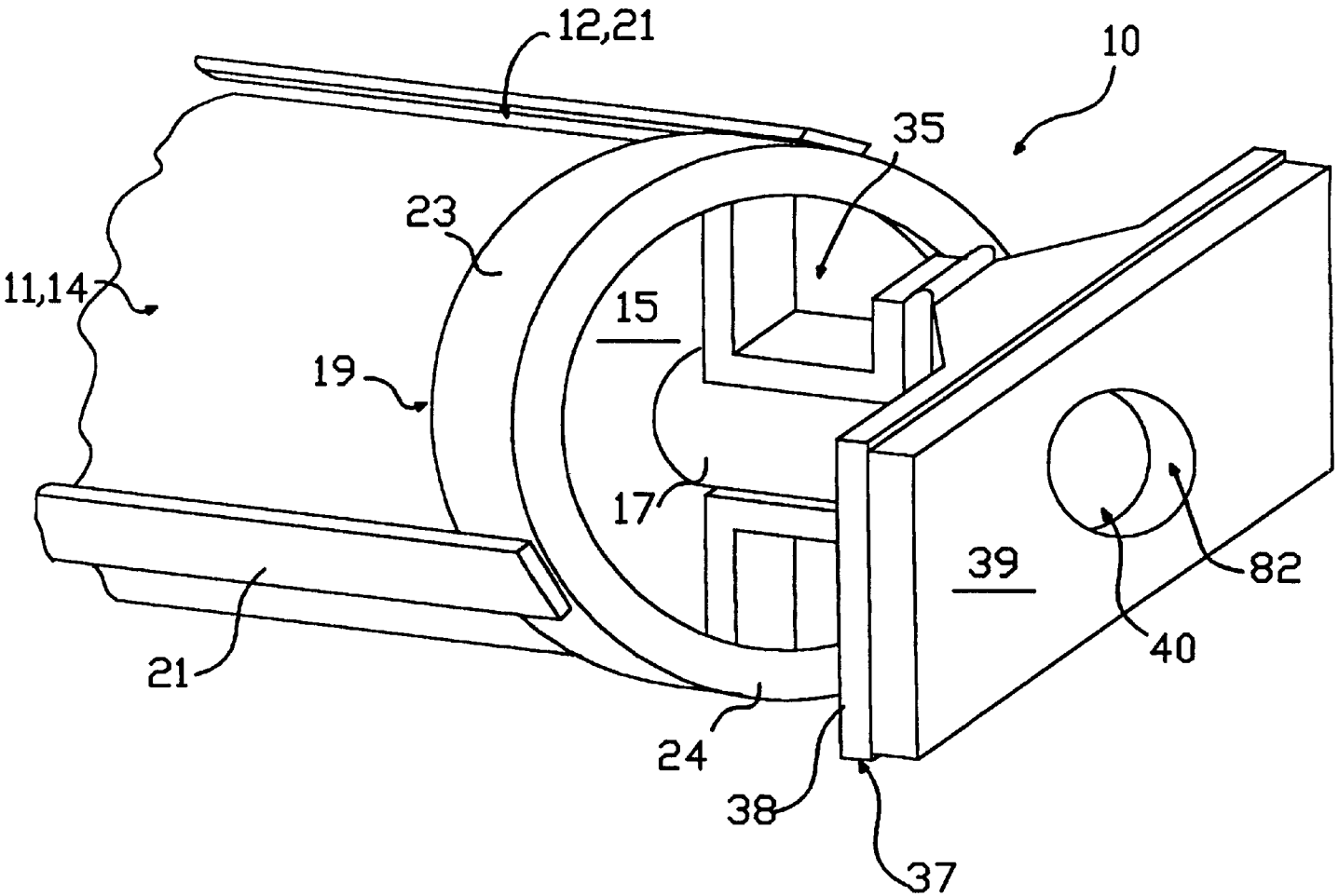
FIG. 1 is a simplified fragmented perspective of a first embodiment of the invention shown cooperating with a caulking gun and caulking cartridge.
Figure 2:
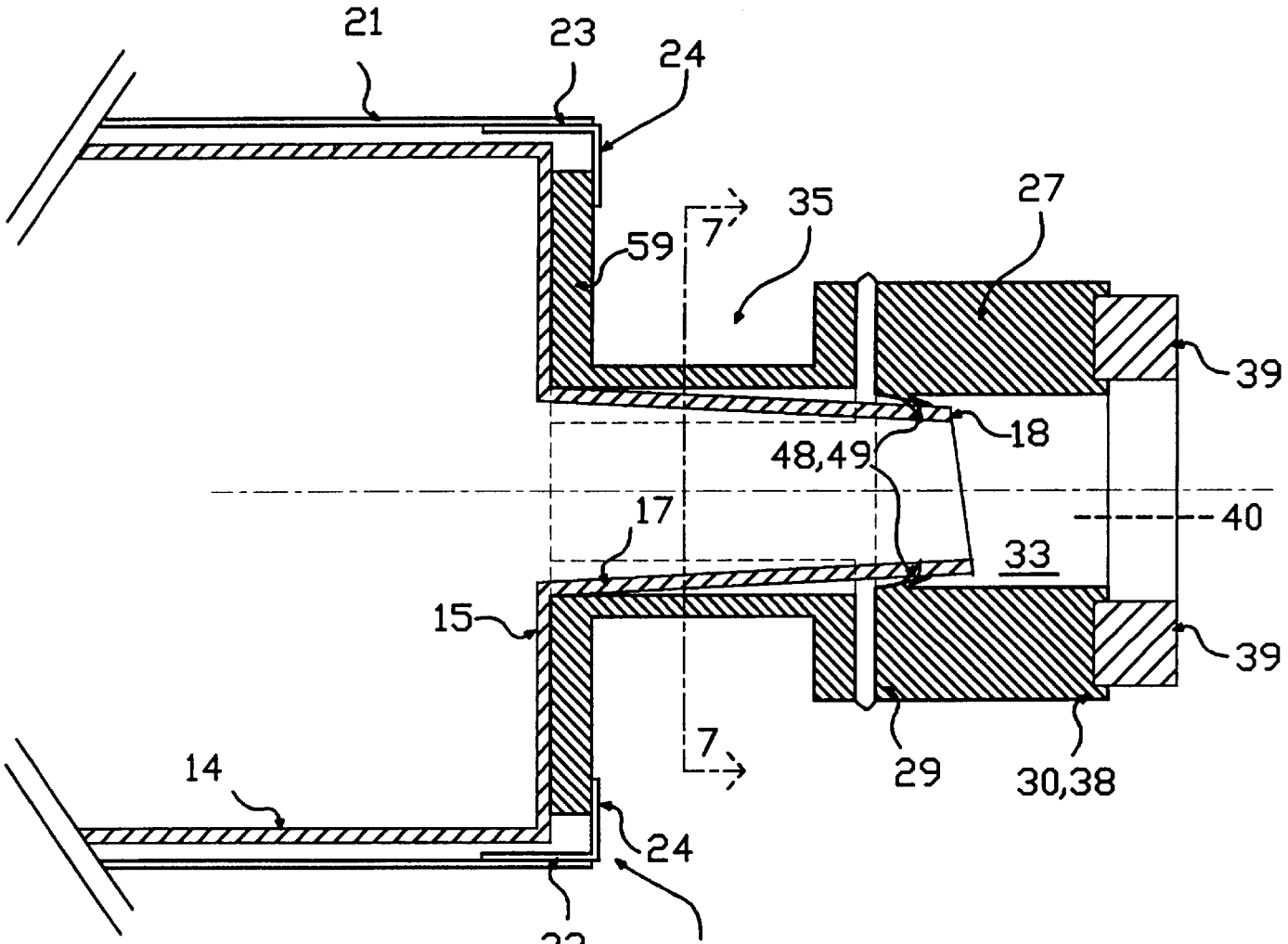
FIG. 2 is a simplified longitudinal section of the first embodiment shown cooperating with the caulking gun and cartridge.

FIGS. 1 and 2

The first embodiment 10 of a caulking accessory or device according to the invention, is for use for sealing cracks on flat surfaces and is shown cooperating with a conventional caulking cartridge 11 and a caulking gun 12. The caulking cartridge has a tubular body 14 having an annular end face 15 and a tapered nozzle or spout 17 extending axially therefrom to a cut end 18. The caulking gun 12 is a "skeleton body" type and has an annular end flange 19 and a plurality of axially extending body strips 21 which cooperate with other portions of the gun and cartridge to apply pressure to the cartridge to force sealant therefrom through the nozzle 17 as is well known. The end flange 19 is L-sectioned and comprises a cylindrical portion 23 and an integral planar portion 24 extending therefrom to provide a clearance opening to receive nozzle 17 extending from the end face 15.

The first embodiment 10 comprises a body 27 having a proximal end portion 29 located on the side of the body closest to the cartridge 11, and a distal end portion 30 located at an opposite end of the body remote from the cartridge. The body has a body opening 33 extending between the end portions, the body opening cooperating with the nozzle 17 of the caulking cartridge as will be described.

The first embodiment further comprises a connecting portion 35 located adjacent the proximal end portion 29 of the body, and a blocking portion 37 located adjacent the distal end portion 30. The blocking portion 37 has a planar rectangular blocking plate 38 with a resilient blocking surface 39 which can cooperate with the surface to be sealed, as will be described with the reference to FIGS. 8 and 9. The blocking plate has a blocking plate opening 40 which communicates with the body opening to receive sealant as will be described.

FIGS. 3–7

Figure 3:
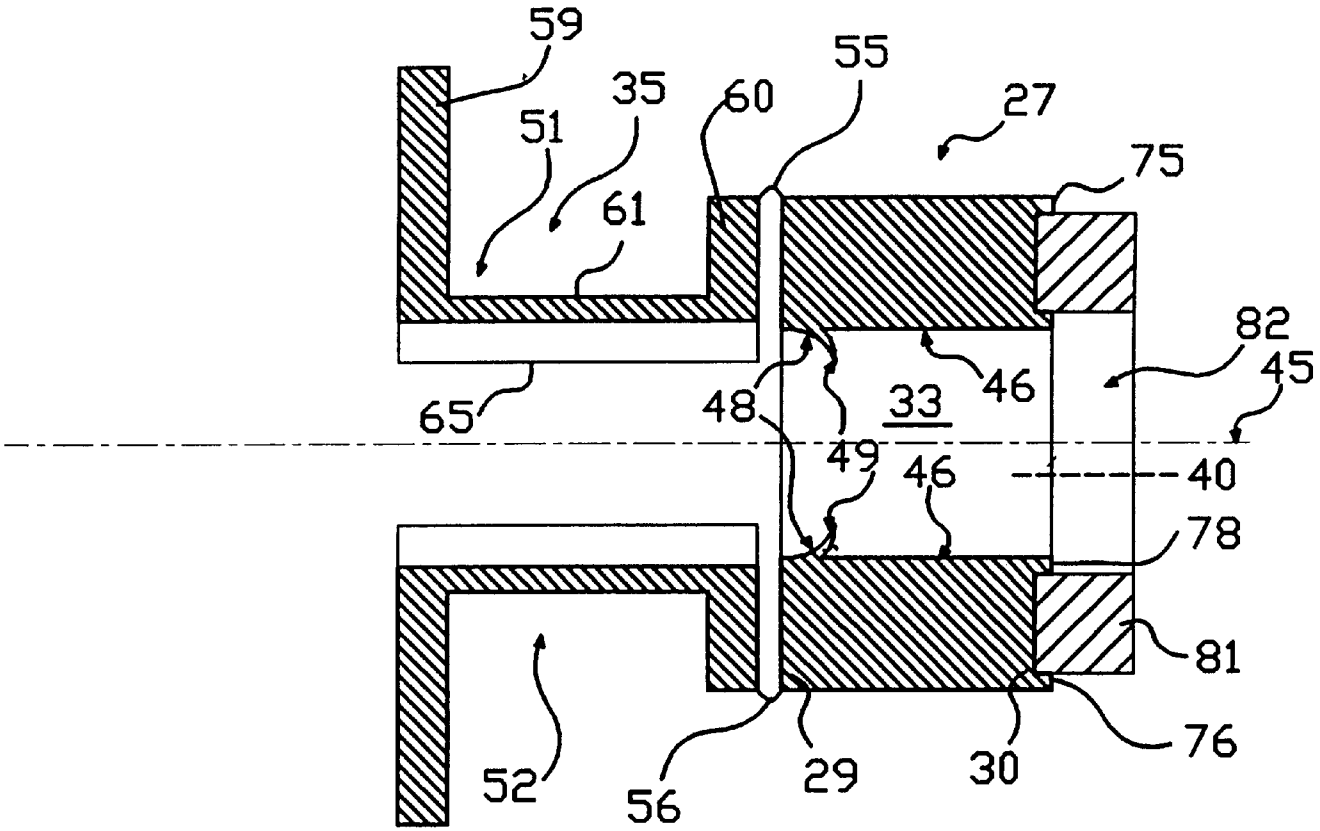
FIG. 3 is a simplified longitudinal section of the first embodiment shown in an operative position remote from the caulking gun.
Figure 5:
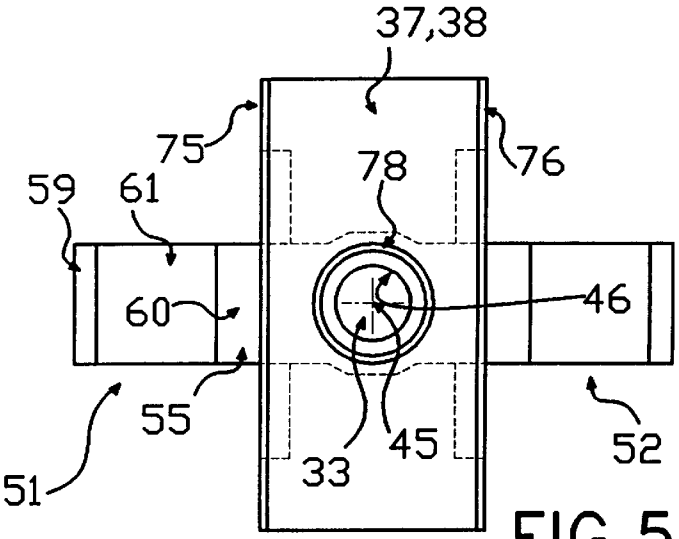
FIG. 5 is a simplified top plan of the first embodiment of FIG. 4 in the inoperative position.
Figure 4:
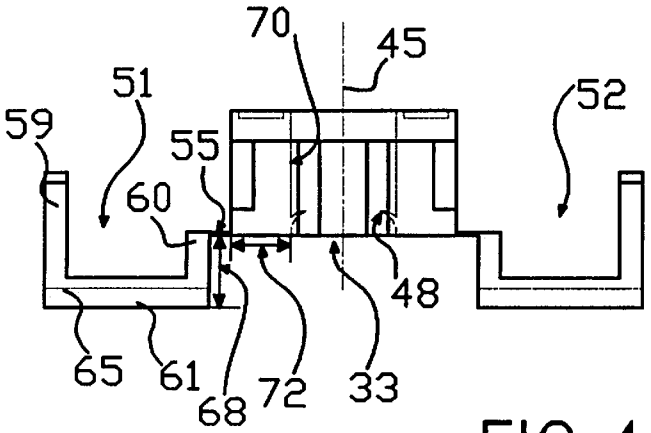
FIG. 4 is a simplified side elevation of the first embodiment shown in an inoperative position as initially manufactured and removed from a manufacturing die.

As seen in FIG. 3, the body opening 33 has an opening axis 45, an opening sidewall 46 and an annular flange 48 with a flexible flange lip 49. The annular flange extends inwardly from the opening sidewall to the lip and is inclined towards the distal end portion 30 of the body for reasons to be described. The connecting portion 35 has first and second movable arms located on opposite sides of the body opening 33 and connected to the proximal end portion 29. As will be described, the arms cooperate with the caulking gun and caulking cartridge so as to be retained on the gun in a manner that is more secure than the conventional annular flange of some prior art caulking accessories. In FIG. 3 (and also in FIGS. 1 and 2) the arms 51 and 52 of the connecting portion are shown in an operative position which permits cooperation with the caulking gun, whereas in FIGS. 4–6 the arms are shown in an inoperable position. Preferably, the present invention is manufactured using cavity die injection techniques, and to simplify die design and manufacture, the device 10 is injected with the arms disposed in the inoperative position as shown in FIGS. 4–6.

The arms 51 and 52 are hinged with respect to the body 27 about respective first and second hinges 55 and 56 which are disposed parallel to each other, i.e. the hinges have undesignated respective hinge axes which are disposed parallel to each other and are also disposed generally perpendicularly to the opening axis 45. The hinges 55 and 56 are injection molded concurrently with other portions of the device, and are thin portions of flexible plastic material, commonly referred to as "living" or "film" hinges. Such hinges can be reversed many times and are simple and low cost to produce.

The arms 51 and 52 are similar to each other and thus only the first arm 51 will be described in detail. The arm 51 has a distal arm portion 59, a proximal arm portion 60 and an intermediate arm portion 61 interconnecting the distal and proximal arm portions. The distal arm portion 59 and proximal arm portion 60 are generally flat plates and extend in similar directions from the intermediate arm portion 61. Thus the portions 59 and 60 are disposed generally parallel to each other, and are also disposed generally perpendicularly to the intermediate arm portion. The distal arm portion 59 cooperates with the caulking cartridge and caulking gun, as will be described with respect to FIG. 2, and the proximal arm portion 60 is connected to the hinge 55 so as to cooperate therewith.

Figure 7:
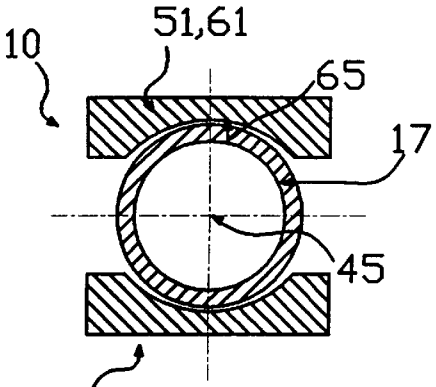
FIG. 7 is a simplified fragmented section on line 7—7 of FIG. 2.
Figure 6:
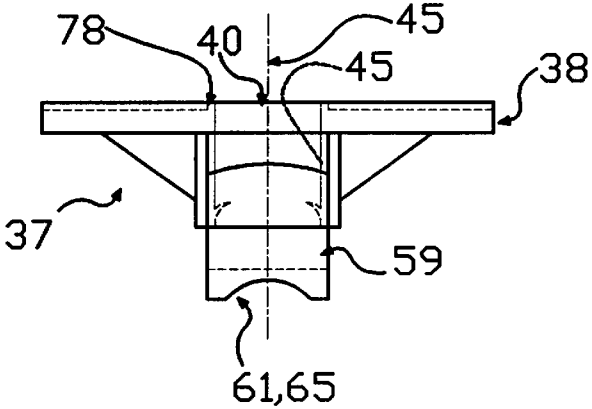
FIG. 6 is a simplified end elevation of the first embodiment of FIG. 4 in the inoperative position.

As best seen in FIG. 6, the intermediate arm portion 61 is generally straight and has a concave inner face 65, and when the arm 51 is in the operative position thereof, the inner face 65 is disposed generally concentrically of the body opening 33 and is shaped to engage a portion of the nozzle 17, the opening axis 45 and nozzle being shown in broken out line in FIG. 6 in relative operative positions. Clearly, the nozzle 17 is not normally positioned adjacent the intermediate portion when the device is in the inoperative position as shown in FIG. 6. As seen in FIG. 3, when the arms are in the operative position, the distal arm portions, e.g. 59, are generally co-planar with each other. The intermediate arm portions, e.g. 61, are disposed parallel to each other and, as best seen in FIG. 7, embrace opposite sides of the nozzle 17 with concave inner surfaces thereof concentric with the axis 45.

As seen in FIG. 4, the proximal arm portion 60 has a length 68 defined by spacing between the hinge axis 55 and the intermediate portion 61. The hinge axis 55 is spaced from a closest adjacent sidewall 70 of the body opening 33 by a distance 72 which is approximately equal to the length 68 of the proximal end portion. In this way, when the arm 51 is in the operative position shown in FIG. 3, the concave surface 65 of the intermediate portion is generally concentric with the axis 45, and thus with the sidewall 46 of the opening as previously described with respect to FIGS. 6 and 7.

The blocking plate 38 has a pair of generally parallel peripheral walls 75 and 76 extending outwardly therefrom, and an annular inner wall 78 extending around the opening 33. As seen in FIG. 3 only, a generally rectangular sheet of expanded foam plastic material 81 is secured, e.g. by gluing, to the outer face of the blocking plate 38 and has an opening 82 generally concentric with the opening axis 45 and complementary to the inner wall 78. The walls 75, 76, and 78 stabilize edges of the foamed plastic material 81 and have a depth less than thickness of the foamed plastic material so that the plastic material stands proud of the edges. When the plastic material is forced against a rough or uneven concrete surface, high spots of the surface deflect the foamed material and depressions at the surface can often be engaged by undeflected portions of the foamed material. This enhances sealing of the uneven surface against the blocking portion thus reducing leakage of sealant between the device and cracked surface as has been described.

OPERATION

The device 10 is usually supplied to the user in the inoperative position as shown in FIGS. 4–6 with the arms 51 and 52 extending outwardly but with the foamed plastic material 81 fitted as shown in FIG. 3.

Referring to FIGS. 1, 2 and 7, the user cuts the nozzle 17 at the cut end 18 which is to be disposed between the annular flange 48 and the distal end portion 30 of the body. As a typical distance between the flange lip 49 and the distal end portion 30 is about 1 cm, the actual location of the cut end 18, or the angle of the cut, is not very critical when compared to prior art cutting of a caulking cartridge nozzle. The nozzle 17 is inserted through the flange 48, and the lip 49 of the flange has a size and flexibility sufficient to cooperate with the nozzle 17 to form a seal therewith. The arms 51 and 52 are rotated about respective hinges 55 and 56 so that concave inner portions of the intermediate arm portions, e.g. 65 of the arms 51 and 52 embrace diametrically opposite portions of the nozzle sidewall, as best seen in FIGS. 2 and 7. The user then inserts the cartridge and the attached accessory 10 into the caulking gun so that the distal arm portions, e.g. 59, are inserted into a small space between the annular end face 15 of the cartridge and the annular planar portion 24 of the end flange 19 of the caulking gun. Any pressure applied to the sealant within the cartridge by the caulking gun results in movement of the end face 15 to squeeze the distal arm portions between the end face and the end flange 19 to provide a secure fit therewith. Furthermore, the arms are of sufficient resiliency to accommodate slight variations in dimensions and taper of the nozzle 17 and yet firmly embrace at least larger diameter portions of the nozzle so that the nozzle and arm portions form a substantially stiff combination to resist compression and any twisting forces that might arise during operation.

Figure 8:
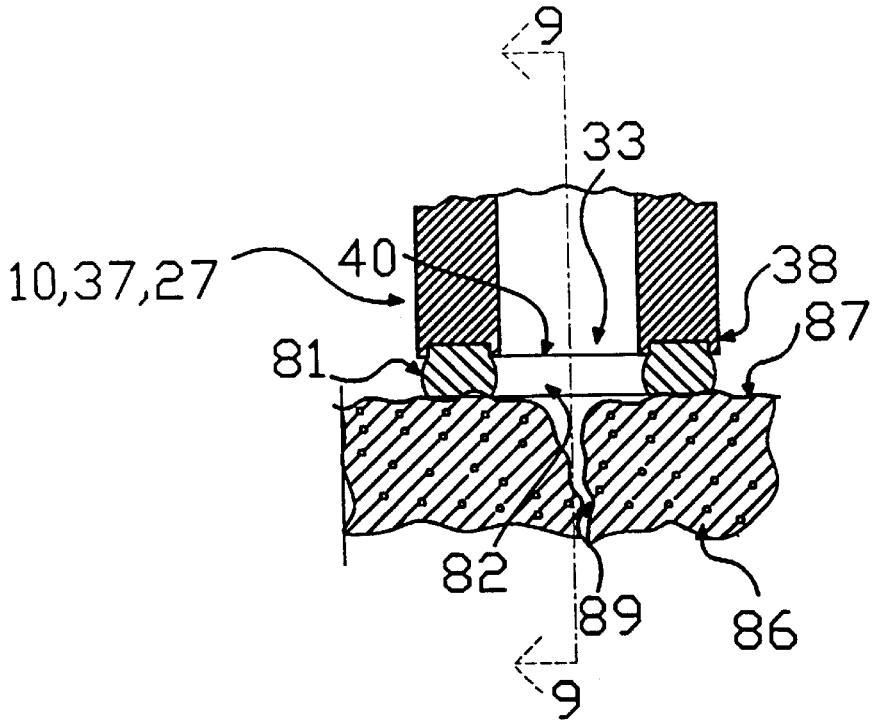
FIG. 8 is a simplified fragmented transverse section through a blocking portion of the first embodiment shown cooperating with a crack in a surface.
Figure 9:
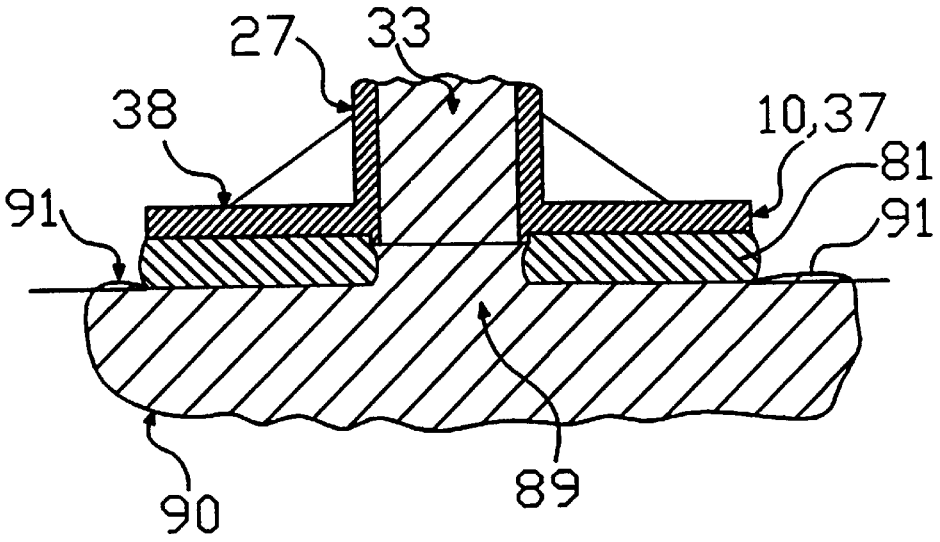
FIG. 9 is a simplified fragmented longitudinal section on line 9—9 of FIG. 8 showing discharge of excess sealant material from the crack.

Referring to FIGS. 8 and 9, a portion of concrete 86 has an uneven surface 87 with a crack 89 extending inwardly from the surface, the crack requiring filling with the sealant from the cartridge. The blocking portion 37 is located above the crack so that the body opening is generally aligned with the crack, and the foamed plastic material 81 straddles the crack as best seen in FIG. 8. An axial force is applied to the caulking gun to deflect the material 81 so that it distorts to accommodate the uneven surface 87, so as to provide an effective seal therewith on opposites sides of the crack. The caulking gun is then operated to inject sealant material 90 through the nozzle of the cartridge, the body opening 33, the blocking plate opening 40 and the opening 82 in the foamed material 81, and then into the crack. Sealant is dispersed within the crack and, depending on the geometry of the crack, the sealant tends to fill the crack immediately adjacent the nozzle and then it is displaced laterally along the crack to eventually approach the concrete surface adjacent edges of the crack. The blocking plate and resiliency in the foamed material 81 to accommodate the uneven surface serve as a block to essentially prevent any sealant 90 from moving outwardly above the surface 87 of the concrete, but excess sealant, designated 91, can exude beyond edges of the blocking plate, thus indicating that immediately adjacent portions of the crack are filled.

It has been found that, with sufficient axial pressure applied to compress the resilient plastic foam material, it is possible to generate higher pressures within the sealant in the crack than would be attained without the resilient material. As sealant pressure tends to build up within the crack, the pressure is transferred into the body opening 33 and acts against the flange 48 which extends inwardly from the sidewall 46 and engages the nozzle 17 at the lip 49. Pressure acting on the flange 48 tend to deflect the flange to enhance sealing which, in turn, permits generation of higher pressures. The enhanced sealing arises because the lip has a sufficient size and flexibility which, when subjected to the sealant pressure, is forced towards the proximal end portion and inwardly towards the opening axis to increase sealing force acting on the nozzle of the caulking cartridge. Thus, the higher the sealing pressure generated in the opening 33, the better the sealing between the flange and the nozzle. Thus the caulking gun can operate at higher pressures than normal and such pressures permit improved penetration of sealant into the crack, which improves adhesion of the sealant to surfaces of the crack, which are generally rough and can provide keying if the sealant is forced strongly against such surfaces. In addition, the high pressure tends to reduce air entrapment within the sealant which improves longevity of the seal.

Once sealant starts to appear at either side of the blocking plate 38, the operator moves the device and gun along the crack a short distance so that the blocking plate slightly overlaps the previously injected sealant, and the process is repeated until sealant appears again adjacent an edge of the blocking plate. This indicates that the crack on that side of the previously applied sealant has now been filled with the recently applied sealant. The device and caulking gun is then moved again, and the process is repeated incrementally along the crack until the crack is filled.

Thus, in summary, the method of the invention comprises a series of discrete injections of sealant at closely spaced locations along the crack, space between the locations being determined by size of the blocking plate. When the crack has been suitably filled with sealant in this manner, the sealant projects somewhat from the crack, often as a series of regular projections and thus it requires smoothing before the sealant cures. Smoothing of the relatively rough sealant can be performed using a spatula, trowel or other sealant applicator.

ALTERNATIVES

The first embodiment of the device is shown for use with a "skeleton type" caulking gun but it can also be used with an alternative earlier design of caulking gun in which the annular end flange 19 is eliminated and an end disc with a radial slot substituted. Usually a semi-cylindrical shell extends along the body of this type of gun to partially enclose the cartridge, thus eliminating the separate axially disposed body strips 21. A procedure to attach the device 10 to the alternative caulking gun is generally similar to that as previously described, as follows. After cutting the nozzle 17, the arms 51 and 52 are swung about the respective hinges to enclose the nozzle 17 of the caulking cartridge (see FIGS. 2 and 7) and the cartridge and device are then moved concurrently laterally into the radial slot of the disc of the caulking gun. When properly installed, the distal arm portions are fitted between the end disc of the caulking gun and the end face of the cartridge and the intermediate arm portions are received in the slot of the end disc. Once the device and caulking cartridge are installed in the alternative caulking gun, the remainder of the operation is identical to that as previously described.

Figure 11:
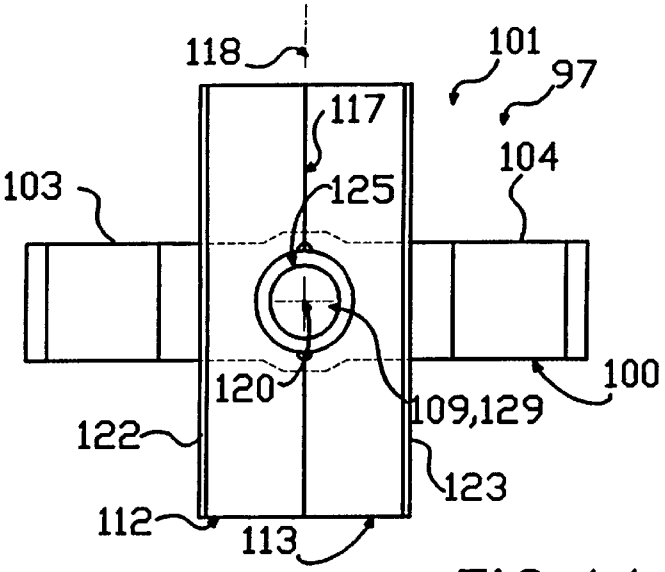
FIG. 11 is a simplified top plan of the second embodiment of FIG. 10.
Figure 12:
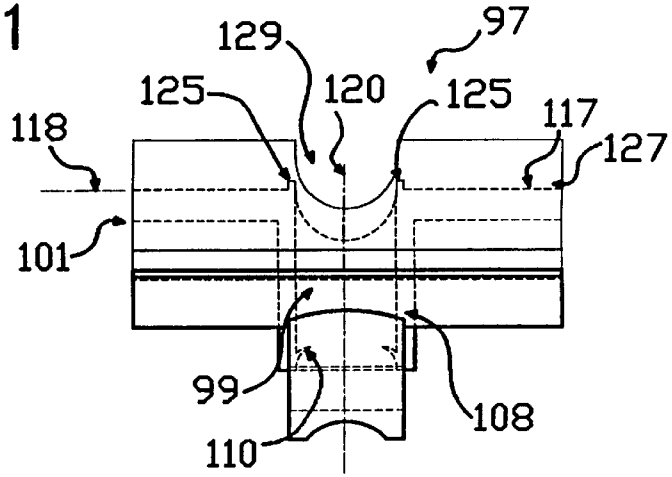
FIG. 12 is a simplified end elevation of the second embodiment of FIG. 10.
Figure 10:
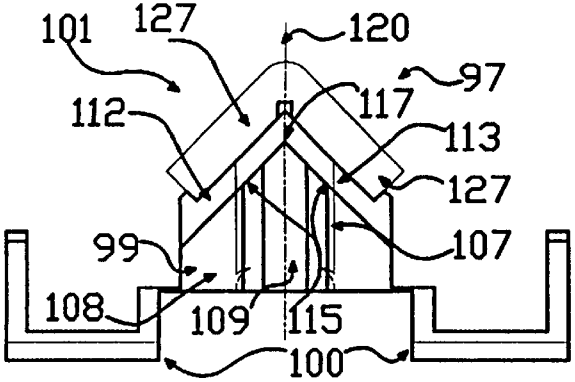
FIG. 10 is a simplified side elevation of a second embodiment of the invention shown in an inoperative position as initially manufactured, but with a resilient blocking surface fitted.

The device 10 is for use in sealing cracks on relatively flat or planar surfaces, e.g. 87 of FIG. 8, and clearly the shape of the blocking portion is selected to conform to the shape of the surface to be sealed. For example, convex or concave surfaces would have corresponding complementary concave and convex blocking portions respectively. A relatively common application of the invention is for sealing cracks in inside corners in which intersecting walls meet at 90 degrees. This requires a complementary V-shaped blocking portion to be described with respect to FIGS. 10–12 as follows.

FIGS. 10–12

The second embodiment 97 of the invention has a body 99, a connecting portion 100 and a blocking portion 101. The connecting portion has first and second arms 103 and 104 which are essentially identical to the arms 51 and 52 and function identically. The body 99 has distal and proximal end portions 107 and 108 and a body opening 109 extending between the end portions as previously described. The arms are hinged to the proximal end portion similarly to the first embodiment, and the body opening 109 has a similar annular flange 110.

This distal end portion 107 is shaped to be complementary to the blocking portion 101 and, in contrast to the first embodiment which has a flat blocking portion, the alternative blocking portion is generally V-shaped to engage a right-angled internal corner. The blocking portion 101 comprises a pair of blocking plates 112 and 113 intersecting at an angle 115 to each other at a blocking corner 117. The blocking corner has a blocking corner axis 118 and the blocking plates intersect each other perpendicularly, i.e. the angle 115 is 90 degrees. The body opening 109 has a body opening axis 120 which intersects the blocking corner axis 118 perpendicularly. The blocking plates 112 and 113 have peripheral walls 122 and 123 respectively, and a pair of projections 125 extend from the blocking corner outwardly and generally parallel to the body opening axis 120.

A rectangular sheet of resilient foamed plastic foamed material 127 is foamed and bonded to the two blocking plates and has an opening 129 generally complementary to the body opening 109 as it penetrates the blocking plates. The material 127 located on the plates 112 and 113 by the walls 122 and 123 and the projection 125. The resilient foamed material 127 provides a resilient blocking surface to accommodate uneven surfaces to be sealed and is functionally equivalent to the resilient foamed plastic material 81 used in the first embodiment.

Operation of the second embodiment is essentially identical to the first in that the second embodiment is moved incrementally along a crack adjacent a corner to apply sealant under elevated pressure to the crack as described with respect to the first embodiment.

What is claimed is:

1. A caulking device for use with a caulking gun, the device comprising:

a) a body having distal and proximal end portions, and a body opening extending between the end portions, the body opening being cooperable with a nozzle of a caulking cartridge, b) a blocking portion located adjacent the distal end portion of the body, the blocking portion communicating with the body opening and having a blocking surface cooperable with a surface to be sealed, and c) a connecting portion located adjacent the proximal end portion of the body, the connecting portion having a pair of movable arms, the arms being located on opposite sides of the body opening and cooperable with the caulking gun and the caulking cartridge so as to be retained on the gun.

2. A device as claimed in claim 1 in which:

a) the body opening has an opening axis, an opening sidewall and an annular flange with a flexible flange lip, the annular flange extending inwardly from the opening sidewall to the lip, the lip having a size and flexibility sufficient to cooperate with the nozzle of the caulking cartridge to form a seal therewith.

3. A device as claimed in claim 2 in which:

a) the lip of the annular flange is inclined towards the distal end portion of the body so as to be forced inwardly towards the opening axis when subjected to sealant pressure.

4. A device as claimed in claim 1 in which:

a) the arms of the connecting portion are hinged to the body to permit movement relative thereto between operable and inoperable positions.

5. A device as claimed in claim 4 in which:

a) the arms are hinged with respect to the body about respective hinges which are disposed parallel to each other.

6. A device as claimed in claim 5 in which:

a) the body opening has an opening axis, and b) the hinges have respective hinge axes which are parallel to each other and disposed generally perpendicularly to the opening axis.

7. A device as claimed in claim 5 in which each arm has:

a) a distal arm portion to cooperate with the caulking cartridge and the caulking gun, b) a proximal arm portion cooperating with the hinge, and c) an intermediate arm portion interconnecting the distal and proximal arm portions and shaped to engage a portion of the nozzle when the arm is in the operative position thereof.

8. A device as claimed in claim 7 in which:

a) the distal arm portion is disposed generally perpendicularly to the intermediate arm portion, and b) the intermediate arm portion has a concave inner face which is disposed generally concentrically of the body opening when the arm is in the operative position thereof.

9. A device as claimed in claim 8 in which:

a) the distal arm portion is a flat plate for locating between the caulking cartridge and the caulking gun.

10. A device as claimed in claim 7 in which:

a) the distal arm portion and the proximal arm portion are disposed generally parallel to each other.

11. A device as claimed in claim 7 in which:

a) the distal arm portion and the proximal arm portion extend in similar directions from the intermediate arm portion.

12. A device as claimed in claim 7 in which:

a) the proximal arm portion has a length defined by spacing between the hinge axis and the intermediate portion, and b) the hinge axis of the arm is spaced from a closest portion of the sidewall of the body opening by a distance approximately equal to the length of the proximal end portion.

13. A device as claimed in claim 1 in which:

a) the blocking surface of the blocking portion is generally planar and disposed generally perpendicularly to the body opening.

14. A device as claimed in claim 1 in which:

a) the blocking portion comprises a pair of blocking plates intersecting at an angle to each other at a blocking corner, the blocking corner having a blocking corner axis, and b) the body opening has an opening axis which intersects the blocking corner axis.

15. A device as claimed in claim 14 in which:

a) the blocking plates intersect each other at an angle of about 90 degrees.

16. A device as claimed in claim 14 in which:

a) the blocking axis and the body opening axis are perpendicular to each other.

17. A device as claimed in claim 1 in which:

a) the blocking surface is resilient so as to accommodate uneven surfaces to be sealed.

18. A device as claimed in claim 1 further including:

a) a sheet of resilient material secured to the blocking portion to provide a resilient blocking surface to accommodate uneven surfaces to be sealed.

19. A caulking device for use with a caulking gun, for delivering sealant under pressure, the device comprising:

a) a body having distal and proximal end portions, and a body opening extending between the end portions, the body opening being cooperable with a nozzle of a caulking cartridge, the body opening having an opening axis, an opening sidewall and an annular flange with a flexible flange lip, the annular flange extending inwardly from the opening sidewall to the lip, the lip having a size and a flexibility sufficient to cooperate with the nozzle of the caulking cartridge to form a seal therewith, and the lip being inclined towards the distal end portion of the body so as to be forced inwardly towards the opening axis when subjected to sealant pressure, b) a blocking portion located adjacent the distal end portion of the body, the blocking portion communicating with the body opening and having a blocking surface cooperable with a surface to be sealed, and c) a connecting portion located adjacent the proximal end portion of the body, the connecting portion being cooperable with the caulking gun and the caulking cartridge so as to be retained on the gun.

* * * * *